United States Patent [19]

Christie et al.

[11] Patent Number: 4,915,825

[45] Date of Patent: Apr. 10, 1990

[54] PROCESS FOR COAL FLOTATION USING 4-METHYL CYCLOHEXANE METHANOL FROTHERS

[75] Inventors: Richard D. Christie, Minooka; Anthony E. Gross, St. Charles; Randall J. Fortin, Osewego, all of Ill.

[73] Assignee: Nalco Chemical Company, Naperville, Ill.

[21] Appl. No.: 353,935

[22] Filed: May 19, 1989

[51] Int. Cl.[4] ..... B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,925,750 | 9/1933 | Cunningham | 209/166 |
| 4,466,887 | 8/1984 | Gross | 209/166 |
| 4,582,596 | 4/1986 | Hansen | 209/166 |
| 4,589,980 | 5/1986 | Keys | 209/166 |
| 4,606,818 | 8/1986 | Keys | 209/166 |
| 4,761,223 | 8/1988 | Klimpel | 209/166 |

FOREIGN PATENT DOCUMENTS

| | | | |
|---|---|---|---|
| 4948603 | 10/1972 | Japan | 209/166 |
| 330688 | 3/1967 | U.S.S.R. | 209/166 |
| 1045938 | 4/1982 | U.S.S.R. | 209/166 |
| 706711 | 4/1954 | United Kingdom | 209/166 |

OTHER PUBLICATIONS

"The Nalco Water Handbook", 2nd Edition, McGraw-Hill Book Co. (1988), pp. 9.15–9.20.

"The Nalco Water Handbook", 2nd Edition, McGraw-Hill Book Co. (1988), pp. 29.3–29.5.

*Primary Examiner*—David L. Lacey

*Assistant Examiner*—Thomas M. Lithgow

*Attorney, Agent, or Firm*—John G. Premo; Paul D. Greeley; Anthony L. Cupoli

[57] ABSTRACT

An improved froth flotation process wherein solid coal particles are selectively separated under coal froth flotation conditions as a froth phase from remaining solid feed particles as an aqueous phase in the presence of a frother, the improvement comprising a frother of at least 4-methyl cyclohexane methanol.

21 Claims, No Drawings

PROCESS FOR COAL FLOTATION USING 4-METHYL CYCLOHEXANE METHANOL FROTHERS

BACKGROUND OF THE INVENTION

The present invention relates to the froth flotation of finely-divided coal particles for separation of the ash therefrom and more particularly to a new frothing agent or frother which enhances coal recovery in the froth flotation process.

In the coal industry, various types of shale and clay are produced as a mixture with the coal. To increase the heating value of the coal and to reduce the hauling costs, a complex process of coal washing is normally used to reduce the total ash content. In this process the coal is graded to a certain size, usually less than six inches, and then fed into a slurry bath in which the density of the media is closely controlled. The coal floats in the heavy media bath while the heavier rocks sink to the bottom. Following this heavy media separation, all the floated material is again sized by vibrating screens for further purification. The smaller size fraction may be processed by shaking tables, hydrocyclones, or froth flotation. In each of these steps, coal is recovered and dried prior to shipment.

Flotation is a process for separating finely ground minerals such as coal particles from their associate waste or gangue by means of the affinity of surfaces of these particles for air bubbles, which is a method for concentrating coal particles. In the flotation process a hydrophobic coating is placed on the particles which acts as a bridge so that the particles may attach to the air bubble and be floated, since the air bubble will not normally adhere to a clean mineral surface such as coal.

In the froth flotation of coal, a froth is formed by introducing air into so-called pulp which contains impure finely divided coal particles and water containig a frothing agent. The flotation separation of coal from the residue or gangue depends upon the relative wettability of surfaces and the contact angle, which is the angle created by the solid air bubble interface.

A frothing agent is utilized to provide a stable flotation froth persistent enough to facilitate the coal separation but not so persistent that it cannot be broken to allow subsequent handling.

Froth flotation is performed in machines specifically designed for the purpose, i.e., the Denver Sub-A machine, and the Wemco machine.

The use of froth flotation to effect a separation of ash particles from coal can be achieved only if liberation of these unwanted particles from the coal has taken place. Most high-grade coals are floatable naturally due to their hydrophobic surface and typically only require a frothing agent for effecting flotation. A frothing agent imparts elasticity to the air bubble, enhances particle-attachment so that the coal is buoyed to the surface of the slurry.

Conventional frothing agents or frothers in the coal flotation process generally have been alcohols and ethers, such as 2-ethyl hexanol, short-chain alkanols, terpene alcohols such as alpha-terpineol, short-chain glycols, sorbitol derivatives, ethoxylated alcohols, mixed alkylene oxide glycol ethers, and alcohol frothers comprising the reaction product of a $C_5$–$C_{10}$ diol and a compound selected from the group consisting of an alkylene oxide and an acrylonitrile. See U.S. Pat. No. 4,606,818 (Keys), issued August 19, 1986.

One problem associated with the conventional frothing agents set forth above is that alcohols, such as 2-ethyl hexanol, are believed to be teratogenic. Use of such alcohols as frothing agents may be hazardous to those who come in contact with such agents and may eventually be banned from use. Therefore, the present inventors have developed a novel froth flotation process which utilizes a unique group of frothing agents or frothers.

These novel frothers overcome the many disadvantages of the aforementioned conventional frothers, as well as provide the following advantages: increased clean coal recovery, a frother having both frother and collector properties when used in coal flotation processes, and avoids the potential health hazards believed to be associated with conventional 2-ethyl hexanol containing products.

Additional advantages of the present invention shall become apparent as described below.

SUMMARY OF THE INVENTION

The present invention is directed to a froth flotation process for beneficiating coal wherein solid coal particles are selectively separated under coal froth flotation conditions as a froth phase from remaining solid feed particles as an aqueous phase in the presence of a frother. The improvement in such process is characterized by a frother comprising at least 4-methyl cyclohexane methanol.

It is an additional object of the present invention wherein the frother may preferably be a composition of 4-methyl cyclohexane methanol and water, with a trace of a monoether of 4-methyl cyclohexane methanol. The frother may also be a composition of 4-methyl cyclohexane methanol, water, a monoether of 4-methyl cyclohexane methanol, a monoester of 4-methyl cyclohexane methanol, a monoaldehyde of 4-methyl cyclohexane methanol, and cyclohexane dimethanol. Other 4-methyl cyclohexane methanol frother compositions are set forth throughout this application and are to be included as part of the present invention.

According to the process of the present invention the frother thereof is used in a dosage ranging from between about 0.05 to about 0.50 lbs/ton of coal.

A further object of the present invention is that the frother may be added to a froth flotation process together with additional collectors, promoters, and/or other frothers. The additional collectors are selected from the group consisting of fuel oils, polymers, and esters. These additional collectors are used in a dosage ranging from between about 0.2 to about 2.5 lbs/ton of coal. The promoters can be used in a dosage ranging from between about 0.01 to about 2 lbs/ton of coal.

The present invention may also include many additional features which shall be further described below.

DESCRIPTION OF THE PREFERRED EMBODIMENTS

A frother comprising at least 4-methyl cyclohexane methanol is used in a froth flotation process wherein solid coal particles are selectively separated under coal froth flotation conditions as a froth phase from remaining solid feed particles as an aqueous phase. The frothers of the present invention are preferably used in the following compositions, although all other compositions known to those skilled in the art are also contemplated hereby.

COMPOSITION 1

The 4-methyl cyclohexane methanol frother of the present invention preferably comprises a mixture of 4-methyl cyclohexane methanol, water, and a monoether of 4-methyl cyclohexane methanol. One preferred frother comprises about 95.9% by weight of 4-methyl cyclohexane methanol, 4% by weight of water, and 0.1% by weight of the monoether of 4-methyl cyclohexane methanol.

COMPOSITION 2

Other frothers may be formed having a general mixture of 4-methyl cyclohexane methanol, water, a monoether of 4-methyl cyclohexane methanol, a monoester of 4-methyl cyclohexane methanol, a monoaldehyde of 4-methyl cyclohexane methanol, and cyclohexane dimethanol. The constituents of such frothers being preferably admixed in the following proportions: 75% by weight of 4-methyl cyclohexane methanol; 3.1% by weight of water; 11.9% by weight of the monoether of 4-methyl cyclohexane methanol; 8.9% by weight of the monoester of 4-methyl cyclohexane methanol; 0.9% by weight of the monoaldehyde of 4-methyl cyclohexane methanol; and 0.1% by weight of cyclohexane dimethanol.

COMPOSITION 3

Still other frothers may be formed having a general mixture of 4-methyl cyclohexane methanol, water, a monoether of 4-methyl cyclohexane methanol, dimethyl 1,4-cyclohexane dicarboxylate, cyclohexane methanol, 1,4-cyclohexane dimethanol, and alcohols. The constituents of such frothers being preferably admixed in the following proportions: 70% by weight of 4-methyl cyclohexane methanol; 7% by weight of water; 7% by weight of the monoether of 4-methyl cyclohexane methanol; 1% by weight of dimethyl 1,4-cyclohexane dicarboxylate; 7% by weight of cyclohexane methanol; 2% by weight of 1,4-cyclohexane dimethanol; and 6% by weight of the alcohols.

COMPOSITION 4

Frothers of the present invention may also be formed from a mixture of 4-methyl cyclohexane methanol, water, a monoether of 4-methyl cyclohexane methanol, dimethyl 1,4-cyclohexane dicarboxylate, 1,4-cyclohexane dimethanol, and alcohols (intermediate boiling compounds). The constituents of such frothers being preferably admixed in the following proportions: 76.6% by weight of 4-methyl cyclohexane methanol; 3.5% by weight of water; 10.6% by weight of the monoether of 4-methyl cyclohexane methanol; 1.4% by weight of dimethyl 1,4-cyclohexane dicarboxylate; 1.8% by weight of 1,4-cyclohexane dimethanol; and 6.1% by weight of the alcohols.

The monoether of 4-methyl cyclohexane methanol is preferably 4-(methoxymethyl) cyclohexane methanol. The monoester of 4-methyl cyclohexane methanol is preferably 4-carbomethoxy cyclohexane methanol.

In accordance with the process of the present invention it is preferable that the desirable cut or fraction of coal fed to the process for flotation be initially washed and then mixed with sufficient water to prepare an aqueous slurry having a concentration of solids which promote rapid flotation. Typically, a solids concentration of from about 2% to about 20% by weight solids, advantageously between about 5 and 10 weight percent solids, is preferred. The aqueous coal slurry is optionally conditioned with additional collectors and/or promoters by vigorously mixing or agitating the slurry prior to flotation in a coal flotation device, such as the DENVER TM or WEMCO TM devices.

The frother is typically used in a dosage ranging from about 0.05 to about 0.50 lbs/ton of coal.

The frother of the present invention may also be added to the froth flotation process together with additional collectors, promoters, and/or other frothers.

Additional collectors are selected from the group consisting of fuel oils, polymers, and esters. Fuel oil is either diesel oil, kerosene, Bunker C fuel oil, and mixtures thereof. One preferred polymeric collector is an alkyl phenol formaldehyde condensate product having 4–5 phenolic nuclei with the alkyl group of the phenol having between 4–15 carbon atoms as described in U.S. Pat. No. 4,466,887 (Gross), issued August 21, 1984, and which is incorporated herein by reference. These additional collectors are used in a dosage ranging from about 0.2 to about 2.5 lbs/ton of coal.

Various promoters may also be combined with the frothers of the present invention. These promoters are preferably selected from the group consisting of: (a) an aromatic or $C_{10}$–$C_{30}$ aliphatic carboxylic acid or an aliphatic ester thereof; (b) a nitrile; (c) the epoxidized, hydroxylated, oxidized, or alkoxylated derivative of promoter (a) or (b), promoter (a) and its derivatives being devoid of nitrogen atoms and the alkoxylated derivatives of promoter (a) being $C_3$ or higher alkoxylated derivatives; (d) a $C_{12}$–$C_{30}$ non-frothing fatty alcohol or its $C_3$ or higher alkoxylated derivative; and (e) mixtures thereof. The promoter is typically used in a dosage ranging from about 0.01 to about 2 lbs/ton of coal. See U.S. Pat. No. 4,606,818 (Keys), issued August 19, 1986, which is incorporated herein by reference.

The frothers of the present invention may also be mixed with other frothers, such as non-toxic frothers, polypropylene glycol frothers, and methyl isobutyl carbinol (MIBC) frothers.

Although not normally used, commercial coal froth flotation operations may include a pH adjustment step to the aqueous coal slurry prior to and/or during flotation, thereby maintaining a pH value of about 4 to about 9, preferably 4 to 8. If the coal is acidic in character, the pH adjustment is made generally by adding an alkaline material to the coal slurry. Suitable alkaline materials include, for example, soda ash, lime, ammonia, potassium hydroxide, magnesium hydroxide, and the like. If the aqueous coal slurry is alkaline in character, an acid is added to the aqueous coal slurry.

Suitable acids include, for example, mineral acids such as sulfuric acid, hydrochloric acid, and the like.

The conditioned and/or pH adjusted aqueous coal slurry is aerated in a conventional flotation machine to float coal. The frothing agent or frother is preferably added to the aqueous coal slurry just prior to flotation or in the flotation cell itself.

The following examples show how the present invention can be practiced but should not be construed as limiting. Each of the below examples was evaluated as a frothing agent using the following coal flotation test procedure: (1) fill a 3 liter flotation cell with appropriate quantity of deionized water, lower impeller and agitate at 1,000 rpms; (2) add pre-weighed coal to flotation cell; (3) condition for 2–3 minutes till all the coal is completely wetted; (4) add frother/fuel oil mixture to surface of flotation cell; (5) condition for approximately one minute; (6) open aeration stopcock; (7) at end of 30 seconds, scrape froth (concentrate) into container for three minutes; (8) filter, dry, and weigh tailings and concentrate; and (9) determine ash content of concentrates and tailings.

EXAMPLE 1

Several frothers of the present invention were prepared as follows:

| | |
|---|---|
| Composition 1 | |
| 95.9% | 4-methyl cyclohexane methanol |
| 4% | water |
| 0.1% | 4-(methoxymethyl) cyclohexane methanol, a monoether |
| Composition 2 | |
| 75% | 4-methyl cyclohexane methanol |
| 11.9% | 4-(methoxymethyl) cyclohexane methanol, a monoether |
| 8.9% | 4-carbomethoxy cyclohexane methanol, a monoether |
| 3.1% | water |
| 0.9% | a monoaldehyde of 4-methyl cyclohexane methanol |
| 0.1% | cyclohexane dimethanol |

The conventional frother used for purposes of comparison was methyl isobutyl carbinol (MIBC). The aforementioned compositions 1 and 2 were compared against MIBC at various frother dosages for treating a coal flotation feed. The results are set forth below in Table 1.

TABLE 1

| Frother | Frother Dosage (lbs/ton) | #2 Fuel Dosage (lbs/ton) | % Yield | % Ash Conc | % Ash Tails | % Ash Calc Heads | % Coal Recov |
|---|---|---|---|---|---|---|---|
| MIBC | .165 | .165 | 43.85 | 8.68 | 63.01 | 39.19 | 65.9 |
| MIBC | .25 | .25 | 53.22 | 8.74 | 77.21 | 40.77 | 82.0 |
| MIBC | .375 | .375 | 57.97 | 9.89 | 82.38 | 40.36 | 87.6 |
| MIBC | .50 | .50 | 58.00 | 12.75 | 85.16 | 43.16 | 89.0 |
| Comp. 1 | .165 | .165 | 44.81 | 8.74 | 64.55 | 39.54 | 67.6 |
| Comp. 1 | .25 | .25 | 59.92 | 11.75 | 82.55 | 40.13 | 88.3 |
| Comp. 1 | .375 | .375 | 64.10 | 13.52 | 86.71 | 39.80 | 92.1 |
| Comp. 2 | .165 | .165 | 41.26 | 8.60 | 61.07 | 39.42 | 62.3 |
| Comp. 2 | .25 | .25 | 59.32 | 11.39 | 81.03 | 39.72 | 87.2 |
| Comp. 2 | .375 | .375 | 65.14 | 13.53 | 86.88 | 39.10 | 92.5 |

Composition 1 resulted in a better total yield and percent clean coal recovery than did the MIBC frother at all dosage levels. For example, at a dosage of 0.375 lbs/ton Composition 1 generated a percent yield of 64.10 and a percent clean coal recovery of 92.1, whereas MIBC generated 57.97% and 87.6%, respectively. At each dosage level both Compositions 1 and 2 out performed MIBC, except that Composition 2 had slightly lower percent yield and percent clean coal recovery at a dosage of 0.165 lbs/ton than MIBC.

EXAMPLE 2

Composition 2 above was evaluated against a conventional alcohol-based frother (sample 1) for use in a froth flotation process in which solid coal was selectively separated under coal froth flotation conditions as a froth phase from remaining solid feed particles as an aqueous phase in the presence of such frothers. The results are set forth below in Table 2.

TABLE 2

| Frother | Dosage (lbs/ton) | Yield (%) | Concentrate Ash(%) | Recovery (%) |
|---|---|---|---|---|
| Sample 1 | 0.1 | 48.7 | 4.53 | 57.8 |
| Sample 1 | 0.2 | 66.6 | 5.95 | 77.2 |
| Sample 1 | 0.3 | 72.6 | 6.25 | 84.2 |
| Comp. 2 | 0.1 | 28.0 | 4.16 | 33.4 |
| Comp. 2 | 0.2 | 63.8 | 5.35 | 74.7 |
| Comp. 2 | 0.3 | 73.7 | 5.78 | 85.7 |

The present invention (Composition 2) demonstrated that it is a viable frother, resulting in percent yield and percent coal recovery comparable to, and at higher dosages greater than, the conventional alcohol-based frother tested.

EXAMPLE 3

Composition 2 above was evaluated against an alcohol-based frother (sample 1) and a conventional 2-ethyl hexanol-based material (sample 2) in a froth flotation process wherein solid coal was selectively separated under coal froth flotation conditions as a froth phase from remaining solid particles as an aqueous phase in the presence of such frothers. Sample 1, sample 2, and composition 2 were mixed with fuel oil in a 1:1 ratio. The results are set forth below in Table 3.

TABLE 3

| Frother | Frother/Oil (lbs/ton) | Yield (%) |
|---|---|---|
| Sample 1 | 0.25 | 69.5 |
| Sample 1 | 0.5 | 79.9 |
| Sample 1 | 0.75 | 81.2 |
| Sample 2 | 0.25 | 71.9 |
| Sample 2 | 0.5 | 78.2 |
| Sample 2 | 0.75 | 79.9 |
| Comp. 2 | 0.25 | 55.6 |
| Comp. 2 | 0.5 | 78.8 |
| Comp. 2 | 0.75 | 81.1 |

Again, the frother of the present invention (Composition 2) demonstrated that it is a viable frother for use in the processing of coal by froth flotation.

While we have shown and described several embodiments in accordance with our invention, it is to be clearly understood that the same are susceptible to numerous changes and modifications apparent to one skilled in the art. Therefore, we do not wish to be limited to the details shown and described, but intend to show all changes and modifications which come within the scope of the appended claims.

What is claimed is:

1. In a froth flotation process wherein solid coal particles are selectively separated under coal froth flotation conditions as a froth phase from remaining solid feed particles as an aqueous phase in the presence of a frother, the improvement comprising a frother comprising a mixture of 4-methyl cyclohexane methanol, water, and a monoether of 4-methyl cyclohexane methanol.

2. The process of claim 1, wherein said 4-methyl cyclohexane methanol is present in an amount of about 95.9%, water is present in an amount of about 4%, and said monoether is present in an amount of about 0.1%.

3. The process of claim 1, wherein said monoether of 4-methyl cyclohexane methanol is 4-(methoxymethyl) cyclohexane methanol.

4. The process of claim 1, wherein said frother is used in a dosage ranging from between about 0.05 to about 0.50 lbs/ton of coal.

5. The process of claim 1, wherein said frother is added to said froth flotation process together with additional collectors, promoters, and/or other frothers.

6. In a froth flotation process wherein solid coal particles are selectively separated under coal froth flotation conditions as a froth phase from remaining solid feed particles as an aqueous phase in the presence of a frother, the improvement comprising a frother comprising a mixture of 4-methyl cyclohexane methanol, water, a monoether of 4-methyl cyclohexane methanol, a monoester of 4-methyl cyclohexane methanol, a monoaldehyde of 4-methyl cyclohexane methanol, and cyclohexane dimethanol.

7. The process of claim 6, wherein said monoether of 4-methyl cyclohexane methanol is 4-(methoxymethyl) cyclohexane methanol.

8. The process of claim 6, wherein said monoester of 4-methyl cyclohexane methanol is 4-carbomethoxy cyclohexane methanol.

9. The process of claim 6, wherein said 4-methyl cyclohexane methanol is present in an amount of about 75%, water is present in an amount of about 3.1%, said monoether is present in an amount of about 11.9%, said monoester is present in an amount of about 8.9%, said monoaldehyde is present in an amount of about 0.9%, and cyclohexane dimethanol is present in an amount of about 0.1%.

10. The process of claim 6, wherein said frother is used in a dosage ranging from between about 0.05 to about 0.50 lbs/ton of coal.

11. The process of claim 6, wherein said frother is added to said froth flotation process together with additional collectors, promoters, and/or other frothers.

12. In a froth flotation process wherein solid coal particles are selectively separated under coal froth flotation conditions as a froth phase from remaining solid feed particles as an aqueous phase in the presence of a frother, the improvement comprising a frother comprising a mixture of 4-methyl cyclohexane methanol, water, a monoether of 4-methyl cyclohexane methanol, dimethyl 1,4-cyclohexane dicarboxylate, cyclohexane methanol, 1,4-cyclohexane dimethanol, and alcohols.

13. The process of claim 12, wherein said monoether of 4-methyl cyclohexane methanol is 4-(methoxymethyl) cyclohexane methanol.

14. The process of claim 12, wherein said 4-methyl cyclohexane methanol is present in an amount of about 70%, water is present in an amount of about 7%, said monoether is present in an amount of about 7%, dimethyl 1,4-cyclohexane dicarboxylate is present in an amount of about 1%, cyclohexane methanol is present in an amount of about 7%, 1,4-cyclohexane dimethanol is present in an amount of about 2%, and the alcohols are present in an amount of about 6%.

15. The process of claim 12, wherein said frother is used in a dosage ranging from between about 0.05 to about 0.50 lbs/ton of coal.

16. The process of claim 12, wherein said frother is added to said froth flotation process together with additional collectors, promoters, and/or other frothers.

17. In a froth flotation process wherein solid coal particles are selectively separated under coal froth flotation conditions as a froth phase from remaining solid feed particles as an aqueous phase in the presence of a frother, the improvement comprising a frother comprising a mixture of 4-methyl methyl cyclohexane methanol water, a monoether of 4-methyl cyclohexane methanol, dimethyl 1,4-cyclohexane dicarboxylate, 1,4-cyclohexane dimethanol, and alcohols.

18. The process of claim 17, wherein said monoether of 4-methyl cyclohexane methanol is 4-(methoxymethyl) cyclohexane methanol.

19. The process of claim 17, wherein said 4-methyl cyclohexane methanol is present in an amount of about 76.6%, water is present in an amount of about 3.5%, said monoether is present in an amount of about 10.6%, dimethyl 1,4-cyclohexane dicarboxylate is present in an amount of about 1.4%, 1,4-cyclohexane dimethanol is present in an amount of about 1.8%, and the alcohols are present in an amount of about 6.1%.

20. The process of claim 17, wherein said frother is used in a dosage ranging from between about 0.05 to about 0.50 lbs/ton of coal.

21. The process of claim 17, wherein said frother is added to said froth flotation process together with additional collectors, promoters, and/or other frothers.

* * * * *